US006670319B1

(12) United States Patent
Cheung et al.

(10) Patent No.: US 6,670,319 B1
(45) **Date of Patent: *Dec. 30, 2003**

(54) BLOOMING TYPE COMPOSITIONS CONTAINING BIPHENYL SOLVENTS

(75) Inventors: Tak Wai Cheung, Bridgewater, NJ (US); Dennis Thomas Smialowicz, West Milford, NJ (US)

(73) Assignee: Reckitt Benckiser Inc., Wayne, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/890,033

(22) PCT Filed: Jan. 25, 2000

(86) PCT No.: PCT/GB00/00206

§ 371 (c)(1),
(2), (4) Date: Nov. 9, 2001

(87) PCT Pub. No.: WO00/44866

PCT Pub. Date: Aug. 3, 2000

(30) Foreign Application Priority Data

Jan. 29, 1999 (GB) ..... 9901876

(51) Int. Cl.[7] ..... C11D 1/88

(52) U.S. Cl. ..... 510/503; 510/365; 510/405; 510/417; 510/426; 510/433; 510/470; 510/504; 510/506

(58) Field of Search ..... 510/503, 417, 510/506, 504, 470, 426, 365, 433, 405

(56) References Cited

U.S. PATENT DOCUMENTS 5,773,398 A 6/1998 Joye et al. ..... 510/245
6,075,002 A * 6/2000 Cheung et al. ..... 510/384
6,177,388 B1 * 1/2001 Cheung et al. ..... 510/101
6,184,195 B1 * 2/2001 Cheung et al. ..... 510/432
6,395,697 B1 * 5/2002 Cheung et al. ..... 510/382

FOREIGN PATENT DOCUMENTS

DE 195 37 782 A1 10/1995
WO WO 98/17763 4/1998
WO WO 98/55570 12/1998
WO WO 99/28428 6/1999
WO WO 99/52361 10/1999

OTHER PUBLICATIONS

Kureha Chem Ind Co. Ltd.; English Abstract for JP 6–220493: Cleaning Solvent for Liquid Crystal Cell, Akatsu Masahiro et al., filed Jan. 29, 1993.

Mitsubishi Petrochem Co Ltd.; English Abstract for JP 2–150497; Detergent Composition, Kanekiyo Takasumi et al., filed Dec. 1, 1988.

* cited by examiner

*Primary Examiner*—Gregory Webb
(74) *Attorney, Agent, or Firm*—Fish & Richardson P.C.

(57) ABSTRACT

Aqueous concentrated liquid hard surface cleaning compositions which bloom when added to a larger volume of water comprise: an organic solvent constituent; binary co-solvent system comprising an alkyl diphenyl solvent and a co-solvent; an amine oxide surfactant constituent; optionally, a further detersive surfactant constituent; and optionally, but desirably, at least one optional constituent selected from chelating agents, coloring agents, light stabilizers, fragrances, thickening agents, hydrotropes, pH adjusting agents, and pH buffers.

35 Claims, No Drawings

BLOOMING TYPE COMPOSITIONS CONTAINING BIPHENYL SOLVENTS

BACKGROUND OF THE INVENTION

The present invention relates to blooming type hard surface cleaning compositions. More particularly the present invention relates to concentrated liquid compositions which are normally diluted in a larger volume of water to form a working solution therefrom, and which exhibit a blooming effect when diluted.

Blooming is a property exhibited by dilutable compositions such as known cleaning compositions, specifically pine-oil type cleaning compositions which contain a significant amount (generally at least about 5% and more) of pine oil. Certain phenolic disinfectant compounds, such as LYSOL(RTM) (where "RTM" indicates a proprietary tradename or trademark) disinfectant concentrate (Reckitt & Colman, Inc., Montvale N.J.) also exhibit such a blooming property. Blooming may be characterized as the formation of milky, creamy or cloudy appearance which is manifested when a dilutable composition is added to a larger volume or quantity of water. Such blooming is particularly desirable in compositions where the blooming characteristic in an aqueous dilution is long lasting.

SUMMARY OF THE INVENTION

Accordingly it is an object of the invention to provide an aqueous concentrated liquid hard surface cleaning composition which blooms when added to a larger volume of water which comprises the following constituents:

an organic solvent constituent;

binary co-solvent system comprising an alkyl diphenyl solvent and a co-solvent;

an amine oxide surfactant constituent;

optionally, a further detersive surfactant constituent;

optionally but desirably at least one optional constituent selected from: chelating agents, coloring agent, light stabilizers, fragrances, thickening agents, hydrotropes, pH adjusting agents, pH buffers, as well as others known the art and useful in similar compositions. The one or more optional constituents are selected to be present, and are included in amounts which do not undesirably affect the overall blooming characteristics of the present inventive compositions.

In preferred embodiments the concentrate compositions provide excellent initial blooming characteristics in 'as mixed' dilutions with water.

It is a further object of the invention to provide such a concentrated liquid hard surface cleaning composition wherein the composition exhibits a blooming effect when diluted in a larger volume of water.

It is among the further object of the invention to provide such a concentrated liquid hard surface cleaning composition wherein the composition exhibits good long term stability, i.e., shelf stability in its concentrated form.

It is a further aspect of the invention to provide a process for the cleaning of hard surfaces utilizing the compositions in either concentrated form or in diluted form as described herein.

DETAILED DISCLOSURE

Desirably, the inventive compositions are essentially free of terpene solvents such as alpha-terpineols or d-limonene which are characteristic of products such as so-called "pine oil" cleaning compositions which typically include such terpene solvents.

The inventive compositions include an organic solvent constituent. Many useful organic solvents may be used, as long as it does not undesirably disrupt the favorable characteristics of the invention, especially the blooming characteristic. Mixtures of two or more organic solvents may also be used as the organic solvent constituent.

Useful organic solvents are those which are at least parally water-miscible such as alcohols, water-miscible ethers (e.g. diethylene glycol diethylether, diethylene glycol dimethylether, propylene glycol dimethylether), water-miscible glycol ether (e.g. propylene glycol monomethylether, propylene glycol mono ethylether, propylene glycol monopropylether, propylene glycol monobutylether, ethylene glycol monobutylether, dipropylene glycol monomethylether, diethyleneglycol monobutylether), lower esters of monoalkylethers of ethyleneglycol or propylene glycol (e.g. propylene glycol monomethyl ether acetate) all commercially available from Union Carbide, Dow Chemicals or Hoescht. Mixtures of organic solvents can also be used.

Particularly useful organic solvents include glycols such as alkylene glycols such as propylene glycol, and glycol ethers. Useful glycol ethers are those having the general structure $R_a$—O—$R_b$—OH, wherein $R_a$ is an alkyl of 1 to 20 carbon atoms, or an aryl of at least 6 carbon atoms, and $R_b$ is an alkylene of 1 to 8 carbons or is an ether or polyether containing from 2 to 20 carbon atoms. Examples of such useful glycol ethers include propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether, propylene glycol phenol ether, and mixtures thereof. Preferred are ethylene glycol n-butyl ether, diethylene glycol n-butyl ether, and mixtures thereof. Such glycol ethers are presently commercially available from a number of sources including in the DOWANOL™ glycol ether from The Dow Chemical Company, Midland Mich. (USA).

Further particularly useful organic solvents monohydric (straight chained or branched) primary, secondary or tertiary lower aliphatic alcohols, especially $C_1$–$C_6$ aliphatic primary and secondary alcohols, of which isopropanol is particularly preferred.

The present inventors have found that inclusion of the organic solvent constituent in amounts of about 0.001% by weight to about 50% by weight have been found to be effective in providing effective cleaning, particularly when the compositions are dispersed into a larger volume of water, as well as in solubilizing other less water soluble constituents present in the concentrate compositions of the invention. Preferably, the organic solvent constituent is present in amounts of from 0.1–40% by weight, and most preferably from about 0.1–35% by weight.

Additionally the inventor has found the according to certain preferred embodiments the organic solvent constituent, comprises, and in certain especially preferred embodiments consist essentially of, both an alkylene glycol such as propylene glycol, and a monohydric lower aliphatic alcohol such as a $C_1$–$C_6$ aliphatic primary and secondary alcohol, especially isopropyl alcohol.

The inventive compositions further also include a binary co-solvent system comprising alkyl biphenyl solvent and a co-solvent which aids in the solubilization of the biphenyl solvent in an aqueous medium.

The alkyl biphenyl solvent is one which may be generally represented by the formula

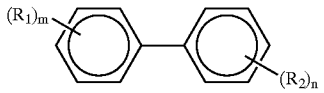

wherein:

$R_1$ is hydrogen or is a lower alkyl radical, preferably a $C_1$–$C_{10}$, but more preferably is a $C_1$–$C_6$ straight chained or branched alkyl radical, $R_2$ is a lower alkyl radical, preferably a $C_1$–$C_{10}$, but more preferably is a $C_1$–$C_6$ straight chained or branched alkyl radical, m is an integer from 1–3 inclusive; and, n is an integer from 1–3 inclusive. Preferably $R_1$ is hydrogen, m is 1, and $R_2$ has any of the values indicated above. More preferably, $R_1$ is hydrogen and m is 1, and $R_2$ is a $C_1$–$C_6$ straight chained or branched alkyl radical. It is to be understood that mixtures of the compounds indicated above may be used as the biphenyl solvent constituent.

Such alkyl biphenyls are, per se, known to the art, and are described in U.S. Pat. No. 3,787,181. Particularly useful as the alkyl biphenyl solvent are materials presently marketed as NUSOLV(RTM) ABP solvents (Ridge Technologies Inc., Ridgewood N.J.) described to be a high purity alkyl biphenyls and mixtures thereof, and is also available from Koch Chemical Co. (Corpus Christi, Tex.) as SURESOL(RTM) solvents.

The alkyl biphenyl solvent may be present in the concentrate compositions in amounts of from about 0.001% by weight to up to about 20% by weight, preferably about 0.01–10% by weight, most preferably in amount of between 0.1–8% by weight.

The inventors have observed that the concentrated compositions of the invention are greatly improved with the addition of a co-solvent. This co-solvent aids in the solubilization of the alkyl biphenyl solvent in water is desirably an at least partially water-niscible monohydric primary alcohol, especially a water-miscible monohydric primary $C_8$–$C_{18}$ alcohol. Particularly effective are cetyl, lauryl and myristyl alcohols, especially lauryl alcohols. The inventors have found that the inclusion of such alcohols greatly aids in the dissolution of the alkyl biphenyl solvents in the concentrate compositions according to the invention being described herein, which aids in ensuring that clarity of the concentrate composition is maintained which is particularly desirable from a consumer standpoint.

The co-solvent may be present in the concentrate compositions in amounts of from about 0.001% by weight to up to about 5% by weight, preferably about 0.01–3% by weight, most preferably in amount of between 0.1–2% by weight.

The concentrate compositions also include one or more amine oxide surfactant constituents. Non-limiting examples of useful amine oxide semi-polar nonionic surfactants include those according to the formulae:

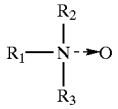

-continued

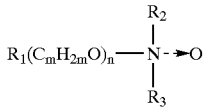

wherein $R_1$ is hydrogen or is an alkyl, 2-hydroxyalkyl, 3-hydroxyalkyl, or 3-alkoxy-2-hydroxypropyl radical where the alkyl and alkoxy parts contain from about 8 to about 18 carbon atoms, $R_2$ and $R_3$ are independently selected from methyl, ethyl, propyl, isopropyl, 2-hydroxyethyl, 2-hydroxypropyl, or 3-hydroxypropyl, m is an integer from 2 to 4, and n is an integer from 0 to about 10. Preferably, the amine oxide semi-polar nonionic surfactants are those according to the formula immediately preceding wherein $R_1$ is an alkyl radical of from 12 to 16 carbon atoms, $R_2$ and $R_3$ are independently selected from methyl or ethyl, and n has a value of 0 or when n has a value of from 1–10, m has a value of 2. Specific examples of such useful amine oxide semi-polar nonionic surfactants include cetyl-, myristyl- or lauryl-dimethyl amine oxide or mixtures thereof.

A further useful general class of useful amine oxides which may be included in the amine oxide constituent according to the invention are further alkyl di(lower alkyl) amine oxides in which the alkyl group has about 10–20, and preferably 12–16 carbon atoms, and can be straight or branched chain, saturated or unsaturated. The lower alkyl groups include between 1 and 7 carbon atoms. Examples include those described above, as well as those in which the alkyl group is a mixture of different amine oxides, dimethyl cocoamine oxides, dimethyl(hydrogenated tallow)amine oxides, and myristyl/palmityl dimethyl amine oxides.

A further class of useful amine oxides include alkyl di(hydroxy lower alkyl)amine oxides in which the alkyl group has about 10–20, and preferably 12–16 carbon atoms, and can be straight or branched chain, saturated or unsaturated. Examples are bis(2-hydroxyethyl)cocoamine oxide, bis(2-hydroxyethyl)tallowamine oxide; and bis(2-hydroxyethyl)stearylamine oxide.

Further useful amine oxides include those which may be characterized as alkylamidopropyl di(lower alkyl)amine oxides in which the alkyl group has about 10–20, and preferably 12–16 carbon atoms, and can be straight or branched chain, saturated or unsaturated. Examples are cocoamidopropyl dimethyl amine oxide and tallowamidopropyl dimethyl amine oxide; and Additional useful amine oxides includes those which may be referred to as alkylmorpholine oxides in which the alkyl group has about 10–20, and preferably 12–16 carbon atoms, and can be straight or branched chain, saturated or unsaturated.

Exemplary amine oxide surfactant constituents include AO-728(RTM) which is described to be a composition containing 50% wt. of bis-(2-hydroxyethyl $C_{12}$–$C_{15}$ alkyloxypropyl)amine oxide (Tomah Products Inc., Milton Wis.), and AMMONYX(RTM) CDO Special described to be cocoamidopropyl dimethyl amine (Stepan Co., Northfield Ill.).

The amine oxide constituent is present in the inventive concentrate compositions in amounts of up to 30% wt., preferably in amounts of from 0.1–30% wt. and still more prefereably in amounts of from 1–20% wt., yet more preferably 12–18% wt. and most preferably about 13–15% wt., based on the total weight of the concentrate composition.

Water is added in order to provide 100% by weight of the concentrate composition. Water is added in amounts which are sufficient to form the concentrated compositions which amount is sufficient to ensure the retention of a substantially clear characteristic when produced as a concentrate, but at the same time ensuring good blooming upon the addition of the concentrated composition to a further amount of water, or upon the addition of further water to the concentrate. The water may be tap water, but is preferably distilled and/or deionized water. If the water is tap water, it is preferably appropriately filtered in order to remove any undesirable impurities such as organics or inorganics, especially minerals salts which are present in hard water which may thus interfere with the operation of the other constituents of the invention, as well as any other optional components of the liquid concentrates according to the invention.

Other conventional additives known to the art but not expressly enumerated here may also be included in the compositions according to the invention. By way of non-limiting example without limitation these may include: chelating agents, coloring agents, light stabilizers, fragrances, thickening agents, hydrotropes, pH adjusting agents, pH buffers as well as one or more detersive surfactants which do not deleteriously detract from the blooming characteristics of the inventive compositions. Many of these materials are known to the art, per se, and are described in *McCutcheon's Detergents and Emulsifiers,* North American Edition, 1982; *Kirk-Othmer, Encyclopedia of Chemical Technology,* 3rd Ed., Vol. 22, pp. 346–387, the contents of which are herein incorporated by reference. Mixtures of two or more such surface active agents may be incorporated into the inventive compositions. Such optional, i.e., non-essential constituents should be selected so to have little or no detrimental effect upon the desirable characteristics of the present invention, namely the blooming behavior, cleaning efficacy, hard surface cleaning activity, and low toxicity as provided by the inventive compositions. Generally the total weight of such further conventional additives may comprise up to 20% by weight of a concentrated composition formulation.

Further optional, but advantageously included constituents are one or more coloring agents which find use in modifying the appearance of the concentrate compositions and enhance their appearance from the perspective of a consumer or other end user. Known coloring agents, may be incorporated in the compositions in effective amount to improve or impart to concentrate compositions an appearance characteristic of a pine oil type concentrate composition, such as a color ranging from colorless to a deep amber, deep amber yellow or deep amber reddish color. Such a coloring agent or coloring agents may be added in any useful amount in a conventional fashion, i.e., admixing to a concentrate composition or blending with other constituents used to form a concentrate composition. However, other colors atypical of pine oil type cleaning concentrates may be used as well. Known art light stabilizer constituents useful in pine oil type compositions may also be added, particularly wherein coloring agents are used in a composition. As is known to the art, such light stabilizers act to retain the appearance characteristics of the concentrate compositions over longer intervals of time.

When a fragrance is included in a concentrate composition being taught herein, the amount of such a fragrance is generally not in excess of 0.5% wt., but is preferably even less, i.e., to 0.20% wt, but generally even less, i.e., to 0.10% wt. It is contemplated that this fragrance constituent may include among its active agents terpene oils (alpha-terpenol, d-Limonene) which is included to provide a fragrance characteristic of a pine oil containing constituent. It is understood that such may be present in the inventive compositions as they may form part of the fragrance constituent forming part of a concentrate composition, but as they are present in only such small amounts they are not considered to be part of a solvent constituent. However, it is noted that the inventive compositions will function and exhibit satisfactory blooming effect without such a fragrance constituent being present.

Exemplary useful buffers include the alkali metal phosphates, polyphospates, pyrophosphates, triphosphates, tetraphosphates, silicates, metasilicates, polysilicates, carbonates, hydroxides, and mixtures of the same. Certain salts, such as the alkaline earth phosphates, carbonates, hydroxides, can also function as buffers. It may also be suitable to use buffers such materials as aluminosilicates (zeolites), borates, aluminates and certain organic materials such as gluconates, succinates, maleates, and their alkali metal salts. Such buffers keep the pH ranges of the compositions of the present invention within acceptable limits.

Exemplary useful pH adjusting agents include known materials which may be used to adjust the pH of the concentrate compositions to a desired range.

The inventive compositions further include optionally, but in certain embodiments, desirably, one or more further detersive surfactants. Useful detersive surfactants include anionic, nonionic, cationic and amphoteric surfactants which are found to not undesirably detract from the blooming characteristics of the present invention.

The useful nonionic surfactants, include known art nonionic surfactant compounds. Practically any hydrophobic compound having a carboxy, hydroxy, amido, or amino group with a free hydrogen attached to the nitrogen can be condensed with ethylene oxide or with the polyhydration product thereof, polyethylene glycol, to form a water soluble nonionic surfactant compound. Further, the length of the polyethylenoxy hydrophobic and hydrophilic elements may various. Exemplary nonionic compounds include the polyoxyethylene ethers of alkyl aromatic hydroxy compounds, e.g., alkylated polyoxyethylene phenols, polyoxyethylene ethers of long chain aliphatic alcohols, the polyoxyethylene ethers of hydrophobic propylene oxide polymers, and the higher alkyl amine oxides.

Exemplary useful nonionic surfactants in the compositions according to the present invention include commercially well known surfactant compositions.

Exemplary nonionic surfactants are certain ethoxylates presently commercially available under the trade name NEODOL(RTM) (Shell Chemical Co., Houston, Tex. (USA)), which are ethoxylated higher aliphatic, primary alcohols Such ethoxylates have an HLB (hydrophobic to lipophilic balance) value of about 8 to 15 and give good oil/water emulsification, whereas ethoxylates with HLB values below 8 contain less than 5 ethylene oxide groups and tend to be poor emulsifiers and poor detergents. Additional satisfactory nonionic surfactant compositions include the condensation products of a secondary aliphatic alcohols containing 8 to 18 carbon atoms in a straight or branched chain configuration condensed with 5 to 30 moles of ethylene oxide. Examples of commercially available nonionic detergents of the foregoing type are those presently commercially available under the trade name of TERGITOL (RTM) (Union Carbide Co., Danbury, Conn.(USA)).

Other suitable nonionic surfactant compositions include the polyethylene oxide condensates of one mole of alkyl phenol containing from about 8 to 18 carbon atoms in a straight- or branched chain alkyl group with about 5 to 30 moles of ethylene oxide, including those which are presently commercially available under the trade name of IGEPAL (RTM) (Rhône-Poulenc, Princeton N.J.(USA)). Further useful nonionic surfactants include the water-soluble condensation products of a $C_8$–$C_{20}$ alkanol with a mixture of ethylene oxide and propylene oxide wherein the weight ratio or ethylene oxide to propylene oxide is from 2.5:1 to 4:1, preferably 2.89:1 to 3.3:1, with the total of the ethylene oxide; and propylene oxide (including the terminal ethanol or proponol group) being from 60–85%, preferably 70 to 80%, by weight. Such include those commercially available under the trade name of PLURAFAC(RTM) (BASF Corp., Hackettstown, N.J. (USA)). Still further useful water-soluble nonionic surfactants include condensation products of a $C_8$–$C_{20}$ alkanols with a mixture of ethylene oxide and/or propylene oxide. Such are commercially available under the tradenarne POLYTERGENT(RTM) (Olin Chemical Co., Stamford Conn.(USA)).

Further suitable water-soluble nonionic surfactants which may also be used include those which are marketed under the trade name PLURONICS(RTM) (BASF Corp., Hackettstown, N.J. (USA)). These are formed by condensing ethylene oxide with a hydrophobic base formed by the condensation of propylene oxide with propylene glycol. Further useful nonionic surfactants include Alkylmonoglyocosides and alkylpolyglycosides which are alkaline and electrolyte stable. Such are prepared generally by reacting a monosaccharide, or a compound hydrolyzable to a monosaccharide with an alcohol such as a fatty alcohol in an acid medium. Various glycoside and polyglycoside compounds including alkoxylated glycosides may be used. An exemplary useful polyglycoside is one according to the formula:

$$R_2O—(C_nH_{2n}O)_w—(Z)_x$$

where Z is derived from glucose, R is a hydrophobic group selected from alkyl groups, alkylphenyl groups, hydroxyalkylphenyl groups as well as mixtures thereof, wherein the alkyl groups may be straight chained or branched, which contain from about 8 to about 18 carbon atoms, n is 2 or 3, w is an integer from 0 to 10, but is preferably 0, and x is a value from about 1 to 8, preferably from about 1.5 to 5. Preferably the alkylpolyglycosides are nonionic fatty alkylpolyglucosides which contain a straight chain or branched chain $C_8$–$C_{15}$ alkyl group, and have an average of from about 1 to about 5 glucose units per fatty alkcylpolyglucoside molecule. More preferably, the nonionic fatty alkylpolyglucosides which contain straight chain or branched $C_8$–$C_{15}$ alkyl group, and have an average of from about 1 to about 2 glucose units per fatty alkylpolyglucoside molecule.

A further exemplary group of alkyl glycoside surfactants suitable for use in the practice of this invention may be represented by formula I below:

$$RO—(R_1O)_y—(G)_xZ_b$$

wherein: R is a monovalent organic radical containing from about 6 to about 30, preferably from about 8 to about 18 carbon atoms; $R_1$ is a divalent hydrocarbon radical containing from about 2 to about 4 carbon atoms; O is an oxygen atom;

y is a number which has an average value from about 0 to about 1 and is preferably 0; G is a moiety derived from a reducing saccharide containing 5 or 6 carbon atoms; and x is a number having an average value from about 1 to 5 (preferably from 1.1 to 2);

Z is $O_2M^1$,

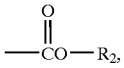

$O(CH_2)$, $CO_2M^1$, $OSO_3M^1$, or $O(CH_2)SO_3M^1$; $R_2$ is $(CH_2)CO_2M^1$ or $CH{=}CHCO_2M^1$; (with the proviso that Z can be $O_2M^1$ only if Z is in place of a primary hydroxyl group in which the primary hydroxyl-bearing carbon atom, $—CH_2OH$, is oxidized to form a

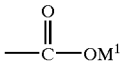

group); b is a number of from 0 to 3x+1 preferably an average of from 0.5 to 2 per glycosal group; p is 1 to 10, $M^1$ is $H^+$ or an organic or inorganic counterion, particularly cations such as, for example, an alkali metal cation, ammonium cation, monoethanolamine cation, or calcium cation.

As defined in Formula I above, R is generally the residue of a fatty alcohol having from about 8 to 30 and preferably 8 to 18 carbon atoms. Examples of such alkylglycosides as described above include, for example, APG™ 325 CS Glycoside® which is described as being a 50% $C_9$–$C_{11}$ alkyl polyglycoside, also commonly referred to as D-glucopyranoside, (commercially available from Henkel Corp, Ambler Pa.) and Glucopon™ 625 CS which is described as being a 50% $C_{10}$–$C_{16}$ alkyl polyglycoside, also commonly referred to as a D-glucopyranoside, (available from Henkel Corp., Ambler Pa.).

Further exemplary useful nonionic surfactants which may be used include certain alkanolamides including monoethanolamides and diethanolamides, particularly fatty mionoalkanolamides and fatty dialkanolamides. Commercially available monoethanol amides and diethanol amides include those marketed under the trade names ALKAMIDE® and CYCLOMIDE® by Rhône-Poulenc Co., (Cranbury, N.J.).

The nonionic surfactants, when present, can be present either singly, or as a mixture of two or more nonionic surfactant compounds as defined above.

Exemplary anionic surfactants include compounds known to the art as useful as anionic surfactants. These include but are not limited to: alkali metal salts, ammonium salts, amine salts, aminoalcohol salts or the magnesium salts of one or more of the following compounds: alkyl sulfates, alkyl ether sulfates, alkylamidoether sulfates, alkylaryl polyether sulfates, monoglyceride sulfates, alkylsulfonates, alkylamide sulfonates, alkylarylsulfonates, olefinsulfonates, paraffin sulfonates, alkyl sulfosuccinates, alkyl ether sulfosuccinates, alkylamide sulfosuccinates, alkyl sulfosuccinamate, alkyl sulfoacetates, alkyl phosphates, alkyl ether phosphates, acyl sarcosinates, acyl isethionates, and N-acyl taurates. Generally, the alkyl or acyl radical in these various compounds comprise a carbon chain containing 12 to 20 carbon atoms.

Further exemplary anionic surface active agents which may be used include fatty acid salts, including salts of oleic, ricinoleic, palmitic, and stearic acids; copra oils or hydrogenated copra oil acid, and acyl lactylates whose acyl radical contains 8 to 20 carbon atoms.

More specific examples of suitable alkyl aromatic sulfonate detergents include the straight chain linear alkyl benzene sulfonates wherein the alkyl group contains 10 to 18 carbon atoms, e.g., averaging about 10 to 15, specific examples of which are sodium dodecyl benzene sulfonate, sodium tridecyl benzene sulfonate and sodium higher alkyl benzene sulfonate wherein the alkyl is of 10 to 15 carbon atoms, averaging about 12.5 carbon atoms per molecular proportion.

Other suitable agents are the surface-active sulfated or sulfonated aliphatic compounds, preferably of 12 to 22 carbon atoms. Within the scope of such definition are the sulfuric acid esters of polyhydric alcohols incompletely esterified with higher fatty acids, e.g., coconut oil monoglyceride monosulfate, tallow diglyceride monosulfate; the long chain pure or mixed alkyl sulfates, e.g., lauryl sulfate, cetyl sulfate; the hydroxysulfonated higher fatty acid esters, such as the higher fatty acid esters of low molecular weight alkyl sulfonic acids, e.g., fatty acid esters of isethionic acid; the fatty acid ethanolamide sulfates; the fatty acid amides of aminoalkyl sulfonic acids, e.g., the lauric acid amide of taurine; olefin and paraffin sulfonates; and the like. More particularly, it is preferred to use the sulfated aliphatic compounds containing at least about 8 carbon atoms, especially those having about 12 to about 18 or 22 carbon atoms in the molecule.

Preferred to use the aliphatic sulfates and sulfonates of about 8 to 22 carbon atoms and the alkyl aromatic sulfonates containing about 8 to about 22 carbon atoms in the alkyl group, preferably of 12 to 18 carbon atoms.

For the synthetic anionic compounds, the alkali metal (e.g., sodium, potassium) salts are preferred, although other salts such as ammonium, lower alkyl amine, i.e., straight or branched chain mono-, di and trialkylamines of 1 to 4 carbons in the alkyl group e.g., methyl amine diisopropyl amine and tributyl amine; lower alkanolamine, e.g., ethanolamine, diethanolamine, triethanolamine and isopropanolamine; and alkaline earth and similar metal, e.g., calcium and magnesium salts; may be used, if desired.

Further exemplary useful anionic surface active agents include alkyl ether carboxylates, particularly those having the general structural formula:

$$R—O—(C_nH_{2n}O)_m—R_1—COO^-M^+$$

wherein R is a straight or branched, long chain, alkyl group containing from 8 to 18 carbon atoms, n is an integer from 2 to 4, m is an integer from 1 to 100, $R_1$ is $CH_2$, $CH_2CH_2$, or $CH_2CH_2CH_2$, and M is a counterion such as an organic or inorganic cation including singly valent cations as well as polyvalent cations. Exemplary cations include cations of an alkali metal including sodium or lithium, or organic cations such as ammonium, diethylammonium, or trimethylammonium cations, as well as other cations not particulary recited here. Such anionic alkyl ether carboxylates are known to be useful as surfactant compositions. In the compositions according to the instant invention, preferably n is 2, m is 4–11, R is $C_9$–$C_{16}$, $R_1$ is $CH_2$ and M is the cation of an alkali metal, preferably sodium. Such surfactants are presently commercially available under the trade name SANDOPAN (RTM) (Clariant Chemical Corp., Charlotte N.C.), NEODOX(RTM) 25-6 and NEODOX(RTM) 23-4 (Shell Chemical Co., Houston, Tex.), as well as SURFINE(RTM) WLG(Finetex Inc., Elmwood Park, N.J.).

Other anionic surface active agents not particularly enumerated here may also find use in conjunction with the compounds of the present invention.

One class of particularly useful detersive surfactants are polymeric alkylene oxide block copolymer. Polymeric alkylene oxide block copolymers include nonionic surfactants in which the major portion of the molecule is made up of block polymeric $C_2$–$C_4$ alkylene oxides. Such nonionic surfactants, while preferably built up from an alkylene oxide chain starting group, and can have as a starting nucleus almost any active hydrogen containing group including, without limitation, amides, phenols, thiols and secondary alcohols.

One group of such useful nonionic surfactants containing the characteristic alkylene oxide blocks are those which may be generally represented by the formula (A):

$$HO—(EO)_x(PO)_y(EO)_z—H \quad (A$$

where

EO represents ethylene oxide,

PO represents propylene oxide, y equals at least 15, $(EO)_{x+z}$ equals 20 to 50% of the total weight of said compounds, and, the total molecular weight is preferably in the range of about 2000 to 15,000.

Another group of nonionic surfactants appropriate for use in the new compositions can be represented by the formula (B):

$$R—(EO,PO)_a(EO,PO)_b—H \quad (B$$

wherein R is an alkyl, aryl or aralkyl group, where the R group contains 1 to 20 carbon atoms, the weight percent of EO is within the range of 0 to 45% in one of the blocks a, b, and within the range of 60 to 100% in the other of the blocks a, b, and the total number of moles of combined EO and PO is in the range of 6 to 125 moles, with 1 to 50 moles in the PO rich block and 5 to 100 moles in the EO rich block.

Further nonionic surfactants which in general are encompassed by Formula B include butoxy derivatives of propylene oxide/ethylene oxide block polymers having molecular weights within the range of about 2000–5000.

Still further useful nonionic surfactants containing polymeric butoxy (BO) groups can be represented by formula (C) as follows:

$$RO—(BO)_n(EO)_x—H \quad (C$$

wherein

R is an alkyl group containing 1 to 20 carbon atoms, n is about 5–15 and x is about 5–15.

Also useful as the nonionic block copolymer surfactants, which also include polymeric butoxy groups, are those which may be represented by the following formula (D):

$$HO—(EO)_x(BO)_n(EO)_y—H \quad (D)$$

wherein n is about 5–15, preferably about 15, x is about 5–15, preferably about 15, and y is about 5–15, preferably about 15.

Still further useful nonionic block copolymer surfactants include ethoxylated derivatives of propoxylated ethylene diamine, which may be represented by the following formula:

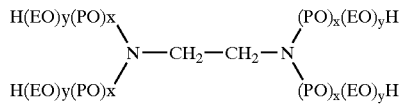

(E)

where (EO) represents ethoxy, (PO) represents propoxy, the amount of $(PO)_x$ is such as to provide a molecular weight prior to ethoxylation of about 300 to 7500, and the amount of $(EO)_y$ is such as to provide about 20% to 90% of the total weight of said compound.

Of these, the most preferred are those which are represented by formula (A) above; specific examples of which include those materials presently commercially available under the tradename PLURONIC(RTM), and in particular the F, L, P, and R serieseach of which are generally described to be block copolymers of propylene oxide and ethylene oxide. Generally those of the PLURONIC(RTM) L series and the PLURONIC(RTM) R series are preferred as these are supplied in liquid form by the manufacturer and are readily formulated into the present inventive compositions. These are also available in a wide range of HLB values, and those having HLB values in the range of 1.0–23.0 may be used, although those with intermediate HLB values such as from about 12.0–18.0 are found to be particularly advantageous. These materials are presently commercially available from BASF AG (Ludwigshafen, Germany) as well as from BASF Corp. (Mt. Olive Township, N.J.).

Other useful exemplary nonionic block copolymers based on a polymeric ethoxy/propoxy units which may also be used include those presently commercially available in the POLYTERGENT(RTM), series of materials from Olin Chemicals Corp., (Stamford Conn.). These are described to be nonionic surfactants based on ethoxy/propoxy block copolymers, conveniently available in a liquid form from its supplier. It is to be understood that these nonionic surfactants based on polymeric alkylene oxide block copolymers may be used singly or in mixtures of two or more such compounds.

Exemplary cationic surface active agents include, by way of non-limiting example, include those which include charged nitrogen containing compounds such as quaternary ammonium compounds, as well as others known to the art. An exemplary and preferred cationic compound quaternary ammonium compounds and salts thereof, which may be characterized by the general structural formula:

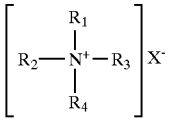

where at least one of $R_1$, $R_2$, $R_3$ and $R_4$ is a alkyl, aryl or alkylaryl substituent of from 6 to 26 carbon atoms, and the entire cation portion of the molecule has a molecular weight of at least 165. The alkyl substituents may be long-chain alkyl, long-chain alkoxyaryl, long-chain alkylaryl, halogen-substituted long-chain alkylaryl, long-chain alkylphenoxyalkyl, arylalkyl, etc. The remaining substituents on the nitrogen atoms other than the abovementioned alkyl substituents are hydrocarbons usually containing no more than 12 carbon atoms. The substituents $R_1$, $R_2$, $R_3$ and $R_4$ may be straight-chained or may be branched, but are preferably straight-chained, and may include one or more amide, ether or ester linkages. The counterion X may be any salt-forming anion which permits water solubility of the quaternary ammonium complex. Certain of these quaternary ammonium compounds may exhibit a germicidal effect, but this is not essential to the present invention.

Exemplary anphoteric surface active agents include, by way of non-limiting example, one or more further known art surfactant compositions, including betaines, ethylene oxide condensates, and fatty acid amides.

Exemplary useful betaine surfactants include those according to the general formula:

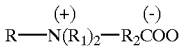

wherein R is a hydrophobic group selected from the group consisting of alkyl groups containing from about 10 to about 22 carbon atoms, preferably from about 12 to about 18 carbon atoms, alkyl aryl, and aryl alkyl groups containing a similar number of carbon atoms with a benzene ring being treated as equivalent to about 2 carbon atoms, and similar structures interrupted by amido or ether linkages; each $R_1$ is an alkyl group containing from 1 to about 3 carbon atoms; and $R_2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammnonium hexanoate.

Useful fatty acid amides include those which are known to the art. Particular exemplary fatty acid amide surfactants include ammonia, monoethanol, and diethanol amides of fatty acids having an acyl moiety which contains from about 8 to about 18 carbon atoms, and which may be represented in accordance with the formula:

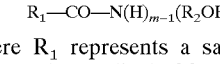

where $R_1$ represents a saturated or unsaturated aliphatic hydrocarbon radical of from about 7 to 21 carbon atoms, but preferably from about 11 to 17 carbon atoms; $R_2$ represents a $—CH_2—$ or $—CH_2CH_2—$, and m is an integer from 1 to 3, but is preferably 1. Preferably, $R_1$ is a saturated or unsaturated aliphatic hydrocarbon radical comprising from about 11 to 17 carbon atoms, and m is 1.

Further examples of such compounds include monoethanol amine coconut fatty acid amide and diethanol amine dodecyl fatty acid amide. An exemplary useful fatty acid amide includes cocomonoethanol amide or cocodiethanolamide, which are presently commercially available as MONAMID(RTM) CMA (Mona Industries, Paterson N.J. (USA)).

What is to be understood by the term "concentrate" and "concentrate composition" in this specification and claims is the pre-consumer dilution and composition of the cleaning composition which is the essentially the form of the product prepared for sale to the consumer or other end user. Such a consumer or other end user would then normally be expected to dilute the same with water to form a cleaning composition. It is to be understood however that nothing in this invention would bar its use as cleaning composition without any further dilution and it may be used in the concentrations in which it was prepared for sale. Similarly, what is to be understood by the term "cleaning compositions" are the water diluted compositions which are expected to be prepared by the consumer or other end user by mixing a measured amount of the "concentrate" with water in order to form an appropriately diluted cleaning composition which is suitable for use in cleaning applications, especially in the cleaning of hard surfaces.

It is also to be understood, that proportions of one or more constituents have been and generally are referred to as percent by weight or as parts by weight based on a measure of 100% by weight, unless otherwise indicated.

According to certain particularly preferred embodiments of the invention there are provided object of the invention to provide an aqueous concentrated liquid hard surface cleaning composition which blooms when added to a larger volume of water which comprises the following constituents:

0.1–35% wt. of an organic solvent constituent;

0.1–12% wt. of a binary co-solvent system comprising an alkyl diphenyl solvent and a co-solvent;

1–20% wt. an amine oxide surfactant constituent;

1–10% wt. of at least one further detersive surfactant constituent;

0–20% wt. of at least one optional constituent selected from: chelating agents, coloring agent, light stabilizers, fragrances, thickening agents, hydrotropes, pH adjusting agents, pH buffers As generally denoted above, the formulations according to the invention include both cleaning compositions and concentrates as outlined above which differ only in the relative proportion of water to that of the other constituents forming such formulations. While the concentrated form of the cleaning compositions find use in their original form, they are more frequently used in the formation of a cleaning composition therefrom. Such may be easily prepared by diluting measured amounts of the concentrate compositions in water by the consumer or other end user in certain weight ratios of concentrate:water, and optionally, agitating the same to ensure even distribution of the concentrate in the water. As noted, the concentrate may be used without dilution, i.e., in concentrate:water concentrations of 1:0, to extremely dilute dilutions such as 1:10,000. Desirably, the concentrate is diluted in the range of 1:0.1–1:1000, preferably in the range of 1:1–1:500 but most preferably in the range of 1:10–1:100. The actual dilution selected is in part determinable by the degree and amount of dirt and grime to be removed from a surface(s), the amount of mechanical force imparted to remove the same, as well as the observed efficacy of a particular dilution. Generally better results and faster removal is to be expected at lower relative dilutions of the concentrate in water.

In accordance with preferred embodiments of the invention, when a quantity of the concentrate compositions taught herein are added to a larger volume of water, a blooming characteristic is manifested. Such "blooming" may be broadly characterized as the formation of milky, creamy or cloudy appearance which is manifested when a dilutable composition is added to a larger volume or quantity of water. Such "blooming" may be alternately characterized as the reduction of transmitted light through an amount of water by at least 30%, desirably by at least 40%, yet more desirably by at least about 50%, and yet most desirably by at least 60% or more when a dilution of the concentrate composition:water with the weight or volume ratio range of from 1:64 to 1:102 is formed. That such blooming may be attained without the use of pine oil fractions as is common in certain commercially available pine oil containing preparations is surprising.

As has been noted, concentrate compositions according to preferred embodiments of the invention exhibit a long lasting blooming effect when they are diluted into a larger volume of water, especially when used to form (weight ratio) dilutions with water of concentrate:water of 1:64 at room temperature. Desirably, such dilutions do not exhibit an increase in light transmittance in accordance with the measurement methods discussed in the Examples below, of more than 50% (based on the initial 'as mixed' value) during its initial three-day interval.

The concentrate compositions according to the invention, and aqueous dilutions formed therefrom, are particularly useful in the cleaning of hard surfaces. By way of non-limiting example, hard surfaces include surfaces composed of refractory materials such as: glazed and unglazed tile, brick, porcelain, ceramics as well as stone including marble, granite, and other stones surfaces; glass; metals; plastics e.g. polyester, vinyl; fiberglass, FORMICA(RTM), CORIAN (RTM) and other hard surfaces known to the art. Hard surfaces which are to be particularly denoted include those associated with kitchen environments, lavatory environments, especially flooring surfaces and the surfaces of fixtures (doors, cabinets, shelving, and the like) in such environments.

Such dilution ratios of concentrate:water as described above may be volume/volume basis, or a weight/weight basis.

The following examples below illustrate exemplary and among them, preferred formulations of the composition according to the instant invention. It is to be understood that these examples are presented by means of illustration only and that further useful formulations fall within the scope of this invention and the claims may be readily produced by one skilled in the art and not deviate from the scope and spirit of the invention.

TABLE 1

| | Ex.1 | Ex.2 | Ex.3 | Ex.4 | Ex.5 | Ex.6 | Ex.7 | Ex.8 |
|---|---|---|---|---|---|---|---|---|
| Isopropyl alcohol | 12.00 | 12.00 | 12.00 | 12.00 | 12.00 | 12.00 | 12.00 | 12.00 |
| propylene glycol | 20.00 | 20.00 | 20.00 | 20.00 | 20.00 | 20.00 | 20.00 | 20.00 |
| lauryl alcohol | 1.00 | 1.00 | 1.00 | 1.00 | 1.00 | 1.00 | 1.00 | 1.00 |
| NUSOLV(RTM) ABP-103 | 2.50 | 2.50 | 2.50 | 2.50 | 2.50 | 2.25 | 2.25 | 2.25 |
| TOMAH(RTM) AO-728 | 14.00 | 14.00 | 14.00 | 14.00 | 14.00 | 14.00 | 14.00 | 14.00 |
| Special | | | | | | | | |
| $Na_2EDTA$ | — | — | — | 0.50 | — | — | — | — |
| SANDOPAN(RTM) LS-24 | 0.73 | — | — | — | — | — | — | — |
| TERGITOL(RTM) 15-S-9 | — | 0.5 | — | — | — | — | — | — |
| PLURONIC(RTM) L64 | — | — | 0.5 | — | — | — | — | — |
| STEOL(RTM) 4N | — | — | — | — | — | 1.79 | — | — |
| BIOSOFT(RTM) D-40 | — | — | — | — | — | — | 1.32 | — |
| STEPANATE(RTM) SXS | — | — | — | — | — | — | — | 1.25 |
| di water | q.s. | q.s. | q.s. | q.s. | q.s. | q.s. | q.s. | q.s. |

The individual constituents were used "as supplied" from their respective manufacturer, and the percent actives of individual constituents are 100% unless otherwise indicated. All of the formulations on Table 1 indicate their constituents in weight percent.

The identity of the constituents indicated on Table 1 are indicated on the following table.

TABLE 2

| | |
|---|---|
| NUSOLV(RTM) ABP-103 | technical grade mixture of alkyl biphenyls (100% wt. actives) from Arristec Inc. |
| TOMAH(RTM) AO-728 Special | bis-2-hydroxyethyl $C_{12}$–$C_{15}$ alkyloxypropyl) amine oxide (50% wt. actives) from Tomah Products Co. |
| SANDOPAN(RTM) LS-24 | sodium lauryl ether carboxylate, (69% wt. actives) from Clariant Inc. |
| TERGITOL(RTM) 15-S-9 | secondary alcohol ethoxylate (100% wt. actives) |
| STEOL(RTM) 4N | sodium laureth sulfate, also known as sodium lauryl ether sulfate (28% actives) from Stepan Co. |
| PLURONIC(RTM) L64 | block copolymer of ethylene oxide/propylene oxide (100% wt. actives) from BASF Inc. |
| BIOSOFT(RTM) D-40 | linear sodium alkyl benzene sulfonate (38% actives) from Stepan Co. |
| STEPANATE(RTM) SXS | sodium xylene sulfonate (40% actives) from Stepan Co. |
| $Na_2EDTA$ | disodium salt of ethylenediaminetetraacetic acid (100% wt. actives) |
| di water | deionized water |

The blooming characteristics of these formulations was characterized by using the Brinkman Sybron (RTM) PC 801 colorimeter. Each tested formulation were diluted with deionised water in a weight ratio of 1:64, and the test was carried out with each of the formulations and water at room temperature (68° F., 20° C.). The resulting determined values, reported as "blooming" in the following table provide an empirical evaluation in percent transmittance (%) of the degree of transparency of a diluted example formulation wherein 0% indicates complete opacity and 100% the transparency of a deionised water sample. The result was tabulated as follows:

TABLE 2

| | % Transmittance |
|---|---|
| Ex. 1 | 33.4 |
| Ex. 2 | 29.3 |
| Ex. 3 | 30.7 |
| Ex. 4 | 21.5 |
| Ex. 5 | 24.4 |
| Ex. 6 | 30.9 |
| Ex. 7 | 19.2 |
| Ex. 8 | 20.3 |

Cleaning Test

The compositions described on Table 1 provide good cleaning efficacy both in their as-mixed, concentrated form, and diluted in water in a weight ratio of 1:64.

What is claimed is:

1. An aqueous concentrated liquid hard surface cleaning composition which blooms when added to a larger volume of water, said composition comprising:

an organic solvent constituent;

a binary co-solvent system comprising an alkyl diphenyl solvent and at least one co-solvent; and an amine oxide surfactant constituent, which composition is essentially free of terpene solvents.

2. A cleaning composition according to claim 1 wherein the alkyl diphenyl solvent is a compound of the formula

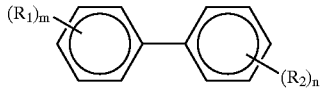

wherein $R_1$ is hydrogen or a $C_1$–$C_{10}$ lower alkyl radical, $R_2$ is hydrogen or a $C_1$–$C_{10}$ lower alkyl radical, m is an integer from 1 to 3, and n is an integer from 1 to 3.

3. A cleaning composition according to claim 2 wherein $R_1$ is hydrogen or a $C_1$–$C_6$ straight chain or branched alkyl radical, and $R_2$ is a $C_1$–$C_6$ straight chain or branched alkyl radical.

4. A cleaning composition according to claim 3 wherein $R_1$ is a $C_1$–$C_6$ straight chained or branched alkyl radical.

5. A cleaning composition according to claim 3 wherein $R_1$ is hydrogen, and m is 1.

6. A cleaning composition according to claim 1 wherein the organic solvent constituent is selected from the group consisting of water-miscible alcohols, ethers, glycol ethers, lower esters of monoalkyl ethers of ethylene glycol or propylene glycol, and mixtures thereof.

7. A cleaning compositions according to claim 1 wherein the organic solvent constituent comprises propylene glycol.

8. A cleaning composition according to claim 6 wherein the organic solvent constituent comprises a glycol ether of the formula $$R_a—O—R_b—OH$$

wherein $R_a$ is a $C_1$–$C_{20}$ alkyl radical or an aryl of at least 6 carbon atoms, and $R_b$ is a $C_1$–$C_8$ alkylene radical or is an ether or polyether having from 2 to 20 carbon atoms.

9. A cleaning composition according to claim 8 wherein the organic solvent constituent comprises propylene glycol methyl ether, dipropylene glycol methyl ether, tripropylene glycol methyl ether, propylene glycol isobutyl ether, ethylene glycol methyl ether, ethylene glycol ethyl ether, ethylene glycol butyl ether, diethylene glycol phenyl ether or propylene glycol phenol ether.

10. A cleaning composition according to claim 9 wherein the organic solvent constituent is ethylene glycol n-butyl ether, diethylene glycol n-butyl ether or a mixture thereof.

11. A cleaning composition according to claim 6 wherein the organic solvent constituent comprises a monohydric $C_1$–$C_6$ primary or secondary alcohol.

12. A cleaning composition according to claim 11 wherein the organic solvent constituent is isopropanol.

13. A cleaning composition according to claim 2 wherein the co-solvent comprises one or more monohydric $C_8$–$C_{18}$ primary alcohols.

14. A cleaning composition according to claim 13 wherein the co-solvent is lauryl alcohol, myristyl alcohol, cetyl alcohol or mixtures thereof.

15. A cleaning composition according to claim 14 wherein the co-solvent is lauryl alcohol.

16. A cleaning composition according to claim 1 which comprises one or more amine oxide surfactants of the formula:

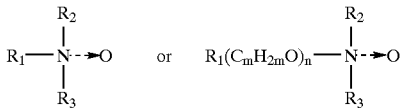

wherein $R_1$ is hydrogen or an alkyl, 2-hydroxyalkyl, 3-hydroxyalkyl, or 3-alkoxy-2-hydroxypropyl radical where the alkyl and alkoxy groups contain from about 8 to about 18 carbon atoms, $R_2$ and $R_3$ are independently selected from methyl, ethyl, propyl, isopropyl, 2-hydroxyethyl, 2-hydroxypropyl, and 3-hydroxypropyl, m is an integer from 2 to 4, and n is an integer from 0 to 10.

17. A cleaning composition according to claim 16 wherein $R_1$ is an alkyl of from 12 to 16 carbon atoms, $R_2$ and $R_3$ are independently selected from methyl and ethyl;

m is 2, and n is an integer of from 1 to 10.

18. A cleaning composition according to claim 16 wherein the amine oxide is selected from cetyl- myristyl- or lauryl-dimethyl amine oxides, mixtures thereof, dimethyl cocoamine oxides, dimethyl (hydrogenated tallow) amine oxides and myristyl/palmityl-dimethyl amine oxides.

19. A cleaning composition according to claim 16 wherein wherein $R_1$ is an alkyl of from 12 to 15 carbon atoms, each of $R_2$ and $R_3$ is 2-hydroxyethyl, and n is 0.

20. A cleaning composition according to claim 19 wherein the amine oxide is selected from bis(2-hydroxyethyl)-cocoamine oxide, bis(2-hydroxyethyl)-tallowamine oxide and bis(2-hydroxyethyl)-stearylamine oxide.

21. A cleaning composition according to claim 16 wherein the amine oxide constituent comprises bis(2-hydroxyethyl)-($C_{12}$–$C_{15}$ alkoxypropyl)-amine oxide.

22. A cleaning composition according to claim 1 wherein the amine oxide constituent comprises an alkylamidopropyldimethylamine in which the alkyl group has from about 10 to about 20 carbon atoms.

23. A cleaning composition according to claim 22 wherein the amine oxide is cocoamidopropyldimethyl amine oxide or tallowamidopropyldimethylamine oxide.

24. A cleaning composition according to claim 1 wherein the amine oxide constituent comprises an alkylmorpholine oxide in which the alkyl group has from 10 to 20 carbon atoms.

25. A cleaning composition according to claim 1 which additionally comprises a further detersive surfactant constituent selected from the group consisting of non-ionic, anionic, cationic and amphoteric surfactants and mixtures thereof.

26. A cleaning composition according to claim 25 in which the further detersive surfactant constituent comprises an alkyl ether carboxylate.

27. A cleaning composition according to claim 25 in which the further detersive surfactant constituent comprises an ethylene oxide/propylene oxide surfactant.

28. A cleaning composition according to claim 25 in which the further detersive surfactant constituent comprises an alcohol ethoxylate.

29. A cleaning composition according to claim 25 in which the further detersive surfactant constituent comprises an alkyl sulfate.

30. A cleaning composition according to claim 25 in which the further detersive surfactant constituent comprises an alkyl sulfonate.

31. A cleaning composition according to claim 25 in which the further detersive surfactant constituent comprises an alkyl benzene sulfonate.

32. A cleaning composition according to claim 1 which includes one or more additional constituents selected from the group consisting of chelating agents, coloring agents, light stabilizers, fragrances, thickening agents, hydrotropes, pH adjusting agents and pH buffers.

33. An aqueous concentrated liquid hard surface cleaning composition which comprises:

0.1–35% wt. of an organic solvent constituent;

0.1–10% wt. of a binary co-solvent system comprising an alkyl diphenyl solvent and a co-solvent;

1–20% wt of an amine oxide surfactant constituent;

0.1–10% wt. of at least one further detersive surfactant constituent;

0–20% wt. of at least one optional constituent selected from the group consisting of chelating agents, coloring agents, light stabilizers, fragrances, thickening agents, hydrotropes, pH adjusting agents and pH buffers.

34. A cleaning composition according to claim 33 which blooms when diluted at a 1:64 v/v ratio in room temperature water.

35. A method for cleaning a hard surface which comprises the step of contacting the hard surface with an aqueous liquid hard surface cleaning composition comprising:

0.1–35% wt. of an organic solvent constituent;

0.1–10% wt. of a binary co-solvent system comprising an alkyl diphenyl solvent and a co-solvent;

1–20% wt. of an amine oxide surfactant constituent;

0.1–10% wt. of at least one further detersive surfactant constituent; and

0–20% wt. of at least one optional constituent selected from the group consisting of chelating agents, coloring agents, light stabilizers, fragrances, thickening agents, hydrotropes, pH adjusting agents and pH buffers, said composition being diluted to a ratio of from 1:64 to 1:102.

* * * * *